US010140897B2

(12) United States Patent
Yin et al.

(10) Patent No.: US 10,140,897 B2
(45) Date of Patent: Nov. 27, 2018

(54) DEEP VIEWER

(71) Applicant: Deep View, LLC, Bellingham, WA (US)

(72) Inventors: Lo I Yin, Silver Spring, MD (US); Way Yin, Bellingham, WA (US); Hwei Yin, Fort Collins, CO (US)

(73) Assignee: DEEP VIEW, LLC, Bellingham, WA (US)

( * ) Notice: Subject to any disclaimer, the term of this patent is extended or adjusted under 35 U.S.C. 154(b) by 0 days.

(21) Appl. No.: 15/647,090

(22) Filed: Jul. 11, 2017

(65) Prior Publication Data

US 2017/0309208 A1 Oct. 26, 2017

Related U.S. Application Data

(63) Continuation-in-part of application No. 14/687,785, filed on Apr. 15, 2015, now Pat. No. 9,734,742.

(51) Int. Cl.
*G09F 19/14* (2006.01)
*G09F 19/02* (2006.01)

(52) U.S. Cl.
CPC ..... *G09F 19/14* (2013.01); *G09F 19/02* (2013.01)

(58) Field of Classification Search
CPC . G09F 19/14; G09F 19/12; G09F 7/20; G09F 7/22
See application file for complete search history.

(56) References Cited

U.S. PATENT DOCUMENTS 371,900 A * 10/1887 Pihlstrom ..... A63H 33/16 446/488
1,655,989 A * 1/1928 Duval ..... G02B 27/2278 352/86
2,151,055 A * 3/1939 Stark ..... B44F 7/00 273/157 A
2,577,320 A * 12/1951 Fenyo ..... B44F 7/00 101/171
3,014,302 A * 12/1961 Hughes ..... B44D 3/22 359/616
3,314,180 A * 4/1967 Porter ..... B44F 7/00 40/436
3,680,227 A * 8/1972 Pavelle ..... G09B 11/00 434/98
4,115,939 A * 9/1978 Marks ..... B65D 23/14 40/310
5,758,440 A * 6/1998 Yudin ..... B65D 23/14 283/109
5,937,554 A * 8/1999 Haugk ..... B05B 11/0005 40/310
8,458,932 B2 * 6/2013 Schnuckle ..... G09F 19/12 40/306
9,032,654 B2 * 5/2015 Wilcoxen ..... A63F 1/02 40/766

* cited by examiner

*Primary Examiner* — Cassandra Davis

(57) ABSTRACT

The present invention relates to a method of displaying an artwork, comprising the steps of: i) providing a complete image, a first substrate, and a second substrate; ii) dividing the complete image into a first image segment and at least one subsequent image segment; iii) imposing the first image segment on the first substrate; iv) imposing the at least one subsequent image segment on the second substrate; and v) positioning the first substrate parallel to the second substrate such that the complete image is revealed with a perception of depth when the first substrate and the second substrate are viewed from a predetermined angle.

13 Claims, 28 Drawing Sheets

10

1

30

3

DEEP VIEWER

The current application is a continuation in part of the U.S. Utility patent application Ser. No. 14/687,785 filed on Apr. 15, 2015.

FIELD OF THE INVENTION

The present invention generally relates to the display of artwork including pictures, text, figures and designs, and more specifically relates to methods of displaying artwork by segmentation and arrangement of a visual representation of an artwork to achieve surprise and a perception of depth.

BACKGROUND OF THE INVENTION

Display of an artwork is a constantly evolving process which is greatly influenced by the artist's creativity, imagination, presenting medium, and the technology available. Different modes for display of indicia and/or images have conventionally been used. For example, certain art forms, created or reproduced on a medium such as planar devices display different images when viewed from different angles. In another example, the use of venetian blind type of devices for alternately hiding or revealing a picture is well known in the field of children's books or amusement devices.

Different types of optical illusions have been employed by a variety of artists including painters, sculptors and photographers for creating a mystery or surprise effect, especially to the viewers or audience. Changing the depth of view constitutes a form of optical illusion which reveals a complete image or structure with a pleasant and surprising perception of depth, when the viewing angle or viewing perspective of the observer is changed from one to another.

SUMMARY OF THE INVENTION

The present invention relates to three-dimensional artwork and methods of displaying an artwork. One such method comprises the steps of: i) providing a complete image, a first substrate, and a second substrate; ii) dividing the complete image into a first image segment and at least one subsequent image segment; iii) imposing the first image segment on the first substrate; iv) imposing the at least one subsequent image segment on the second substrate; and v) positioning the first substrate parallel to the second substrate such that the complete image is revealed with a perception of depth when the first substrate and the second substrate are viewed from a predetermined angle.

In an embodiment, the present invention relates to a deep viewer comprising an image reproduced on one or more faces of a substrate material and the image bearing substrate material is segmented and arranged in parallel planes. The plurality of segments in parallel planes provides no clue of the complete image when viewed from a first view point due to the disassembled view of segments. However, upon viewing from a second viewpoint, a complete image will be revealed with an additional unexpected sensation of depth. The substrate material bearing the artwork may comprise a two-dimensional or three-dimensional object.

DETAIL DESCRIPTIONS OF THE INVENTION

All illustrations of the drawings are for the purpose of describing selected versions of the present invention and are not intended to limit the scope of the present invention.

The following detailed description of the preferred embodiments presents a description of specific embodiments to assist in understanding the claims. However, the present invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be evident to one of ordinary skill in the art that the present invention may be practiced without these specific details.

The present invention relates to a three-dimensional artwork and methods thereof for displaying the artwork. One method comprises the steps of: i) providing an artwork comprising an image, real or virtual; ii) dividing and separating the image into a plurality of segments; iii) arranging the plurality of segments in parallel planes, such that the segments are oriented with respect to their original positions within the image; iv) viewing the plurality of segments from a viewpoint; and v) changing the viewpoint to a predetermined angle where it reveals a complete image with a surprising sensation of depth.

In an embodiment, the present invention relates to a deep viewer comprising an image reproduced on one or more faces of a substrate material and the image bearing substrate material is segmented and arranged in parallel planes. The plurality of segments in parallel planes provides no clue of the actual image when viewed from a first view point due to the disassembled view of segments. However, upon viewing from a second viewpoint, a complete image will be revealed with an additional unexpected sensation of depth. The substrate material bearing the artwork may comprise a two-dimensional or three-dimensional object.

Figure 1A:
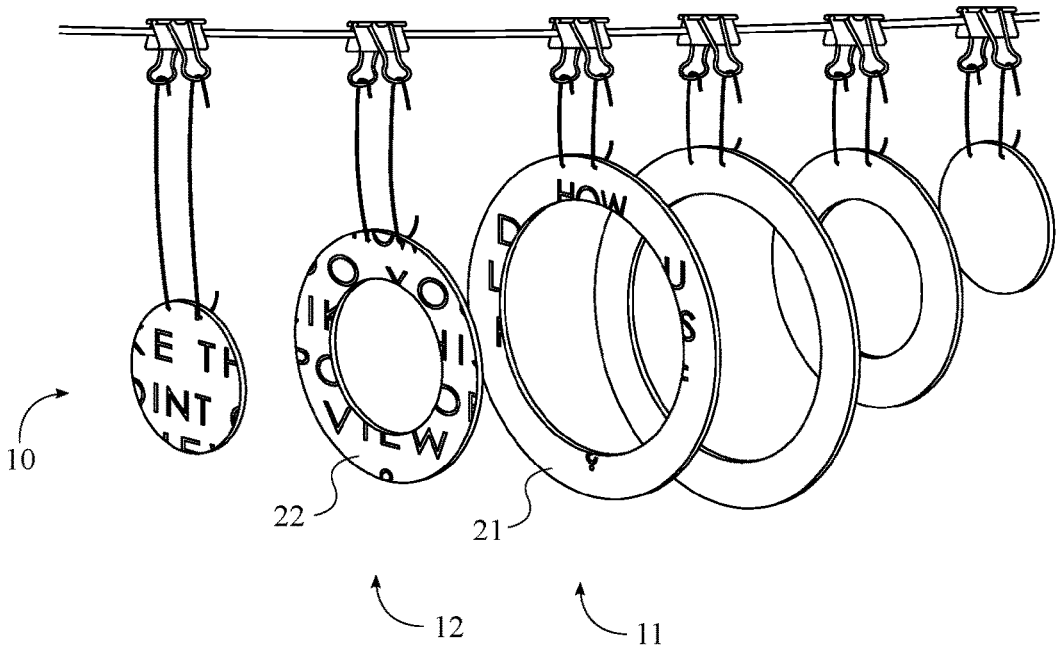
FIG. 1A is an oblique view of an artwork displayed according to a method of the present invention.

Referring to FIG. 1A, which shows an oblique view of an artwork displayed according to a method of the present invention. The artwork comprises an image comprising a picture or text reproduced on a substrate material such as a cardboard, plastic, ceramic, metal and the like. The image bearing substrate is cut into, or produced as, a plurality of segments and arranged in separate planes parallel to each other. The segments can be arranged by means of suspending support or similar structure such that the orientation of each segment with respect to the original complete image is kept intact, although in a separated position. When viewed from one or more viewpoints, for example an oblique viewpoint as shown in the FIG. 1A, the segments are visible separately with the broken image components that do not constitute a complete picture or text with meaning.

Figure 1B:
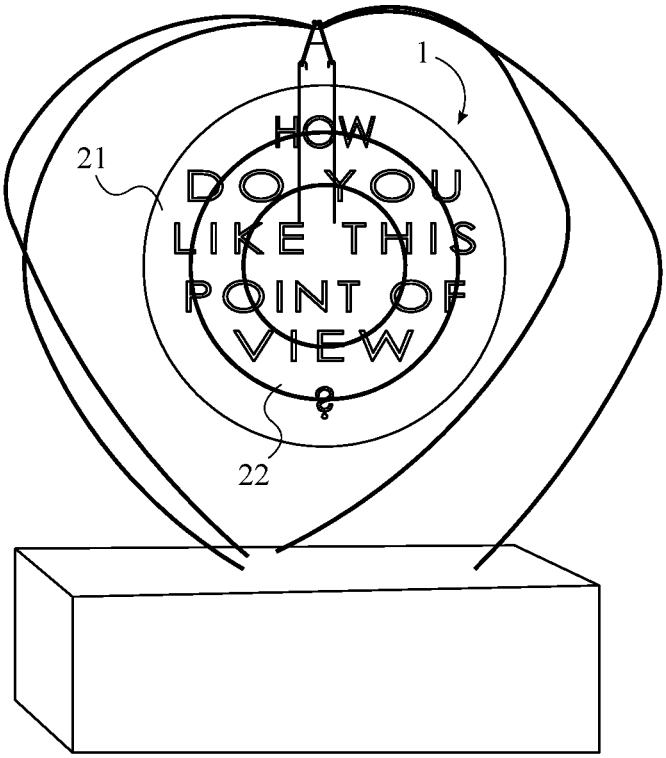
FIG. 1B is a frontal view of the artwork displayed according to the method of the present invention.

When the viewpoint or perspective of the viewer is changed to a predetermined angle, the segments begin to reveal a complete image. For example, when the viewpoint is changed from oblique view to a frontal view, the segments reveal a complete image from the frontal view as shown in FIG. 1B with a perception of depth. In an embodiment, the viewpoint or perspective is changed by movement of a rotating platform which holds the assembly comprising a plurality of image segments arranged in parallel planes, while the viewer or observer is in a stationary position. Alternatively, the viewer or observer can alter his/her viewpoint by moving around in one or more directions, for example: a viewer can initially view the artwork from one of the sides and then walk around the artwork towards the front side for viewing the ensemble of segments head-on. The artwork comprising an ensemble of segments, when viewed from lateral side shows no clue of the actual image but when viewed head-on from the front side, the segments begin to reassemble visually and reveal a complete image, thus providing a pleasant and surprising sensation of depth due to the separation of segment planes. The sensation of depth may be enhanced by the use of augmented perspectives of depth in the artwork itself.

Figure 2A:
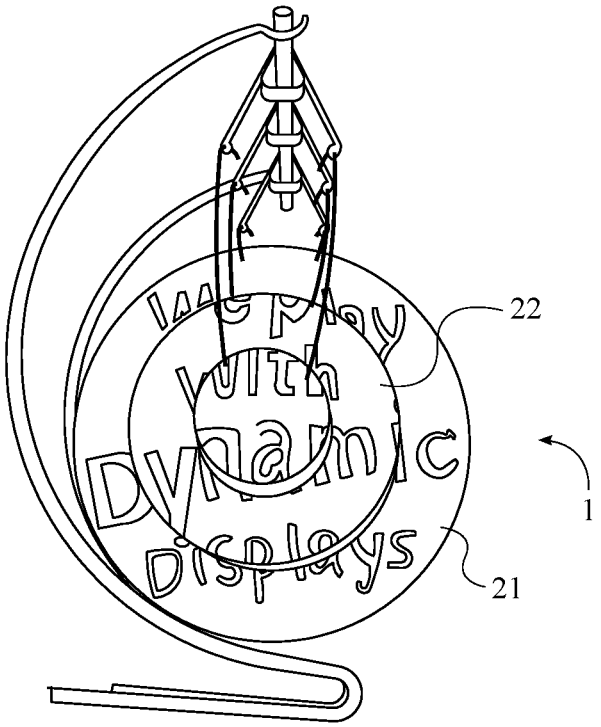
FIG. 2A is a frontal view of an artwork on ceramic tiles displayed according to a method of the present invention.
Figure 2B:
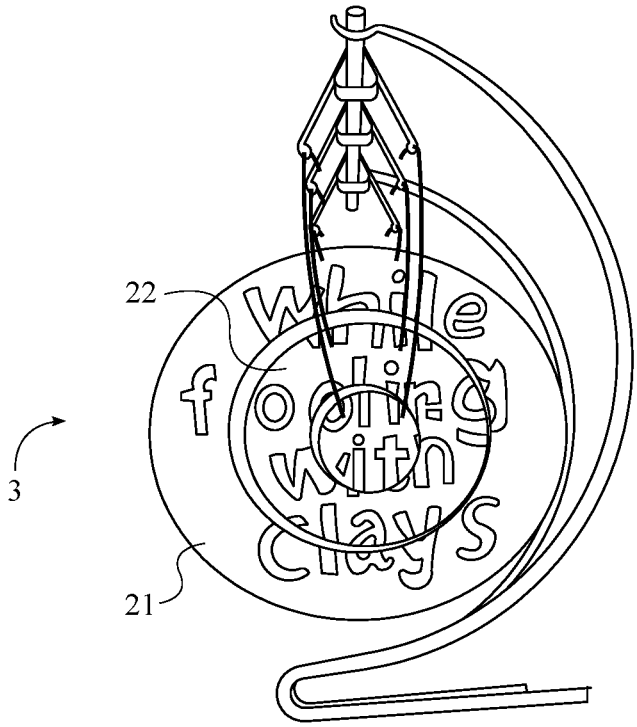
FIG. 2B is a rear view of an artwork on ceramic tiles displayed according to a method of the present invention.

In an embodiment, a two-dimensional object can be used as a substrate material upon which an artwork can be reproduced or affixed. For example: a substrate material bearing two different images (first and second image) on the front face and the rear face can be segmented and arranged in separate parallel planes, so that when viewed from an oblique angle, merely segments of an image are visible to a viewer but begin to reveal a complete first image when viewed head on from the front side and a complete second image when viewed from the rear side, with a surprising sensation of depth. FIG. 2A shows a frontal view of segmented ceramic tile substrate displaying a complete first image on the front side. FIG. 2B shows a rear view of segmented ceramic tile substrate displaying a complete second image on the rear side. Concentrically arranged moving substrate segments adapted to rotate or counterrotate at different speeds provide a depth of view of the artwork to viewers circumferentially. For example, such artworks can be displayed by suspending or erecting concentric segments bearing artwork above a booth at a trade show or science exhibition.

Figure 3A:
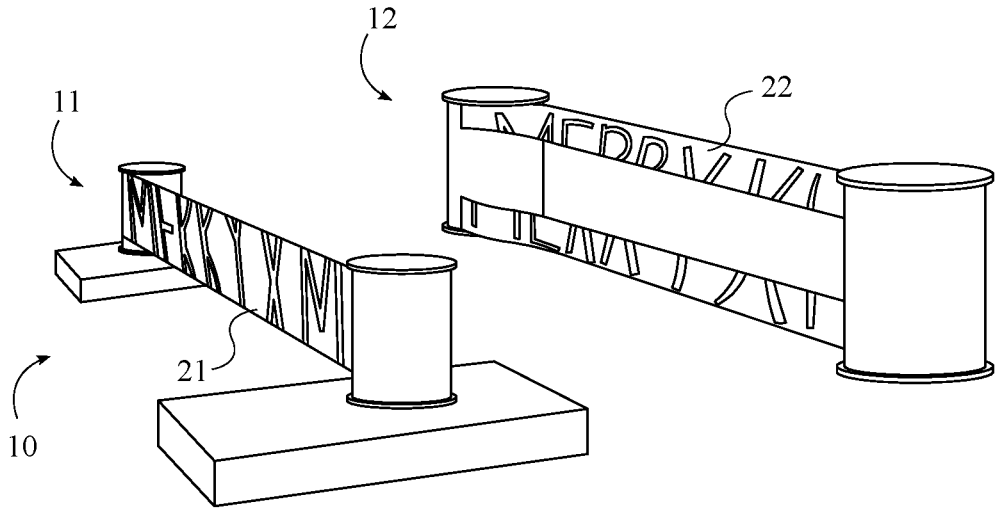
FIG. 3A is an oblique view of an artwork displayed in moving strips according to a method of the present invention.
Figure 3B:
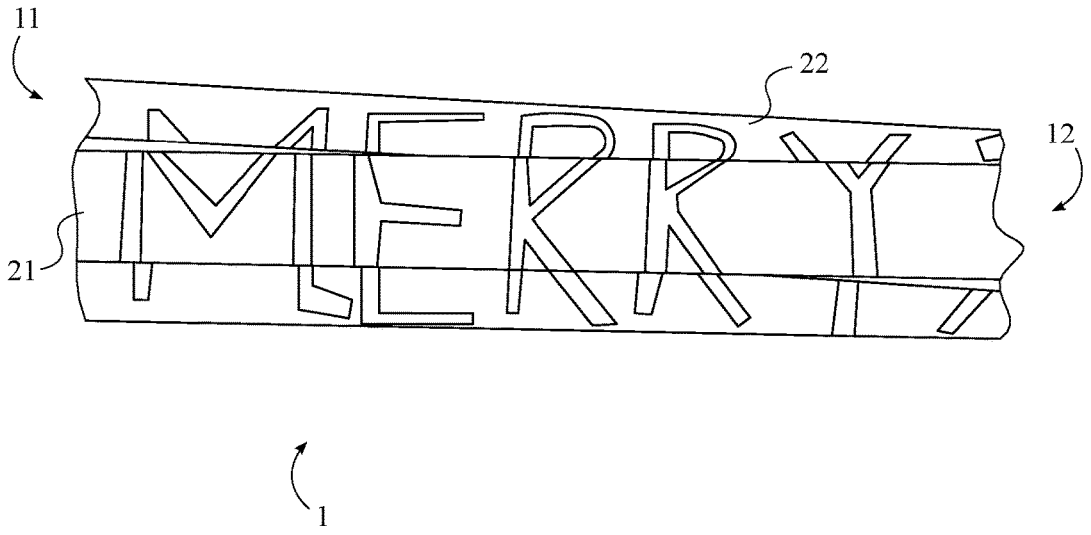
FIG. 3B is a frontal view of the artwork displayed in moving strips according to a method of the present invention.

In another embodiment, the substrate material may comprise moving strips bearing an artwork such as an image or text, the strip can be segmented and arranged in parallel planes, such that the strip segments reveal a complete image when viewed from front side. For example: the strip may comprise a text reading "MERRY X MAS", which can be cut into multiple horizontal strips and arranged in parallel planes for viewing from different perspectives. FIG. 3A shows an oblique view of a text image displayed in moving strips segmented and arranged in parallel planes. The arrangement of strip segments show an incomplete text when viewed from an oblique angle. FIG. 3B shows a frontal view of a text image displayed in moving strips segmented and arranged in parallel planes. The arrangement of strip segments begins to reveal the complete text, reading "MERRY X MAS" in this example, when viewed from the front side.

The present method of display of artwork employs the principle of depth viewing, which can be used to create and display art works including sculptures, paintings, pictures, greeting cards, patterns or abstract displays which are real or virtual, etc., with unlimited variations in number, shape and pattern of divided segments. The above method can also be used for displaying pictures or images in books, games and display of art work, models or exhibits at planetariums, museums, science exhibits, trade shows, amusement parks, marketing or advertising displays, sequential billboards, sport events displays, even complex of buildings and similar venues. In an embodiment, the substrate segments bearing the artwork can be arranged to move with respect to each other in such a way so as to reveal an actual image when viewed from one or more specific viewpoints or viewing angles.

The image bearing substrate material or the parallel planes comprising the segments of image can be multifaceted, such as a polyhedron, thus accommodating more than two images. For example, the multifaceted structures bearing image segments can be manufactured with a 3-D printer and arranged in such a way that, when these parallel segmented facets are rotated synchronously the viewer can experience depth-viewing of multiple pictures.

Figure 4A:
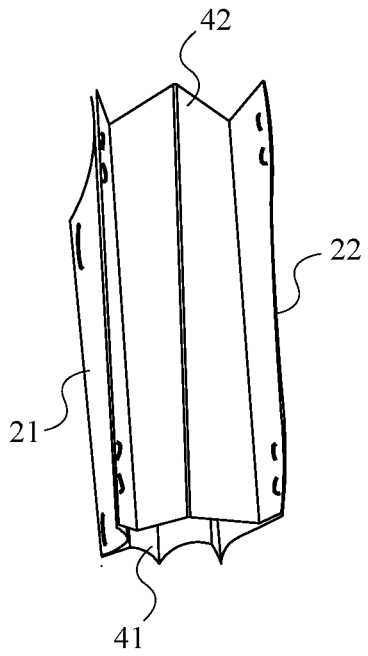
FIG. 4A is a side view of a greeting card arranged according to a method of the present invention.
Figure 4B:
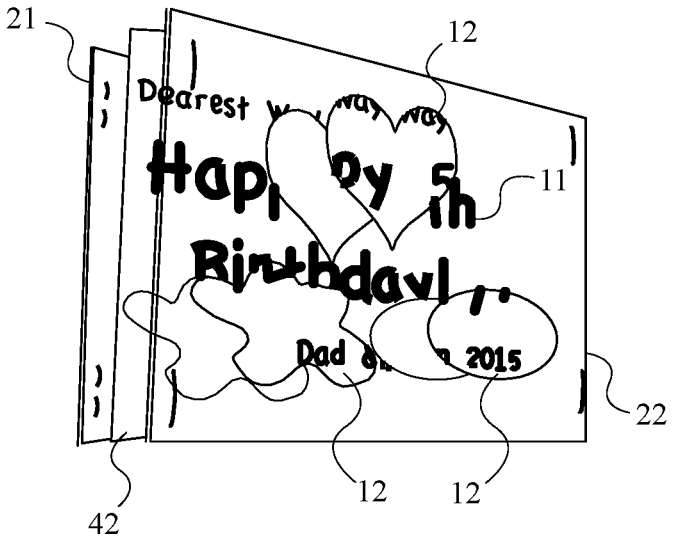
FIG. 4B is an oblique view of the greeting card arranged according to a method of the present invention.
Figure 4C:
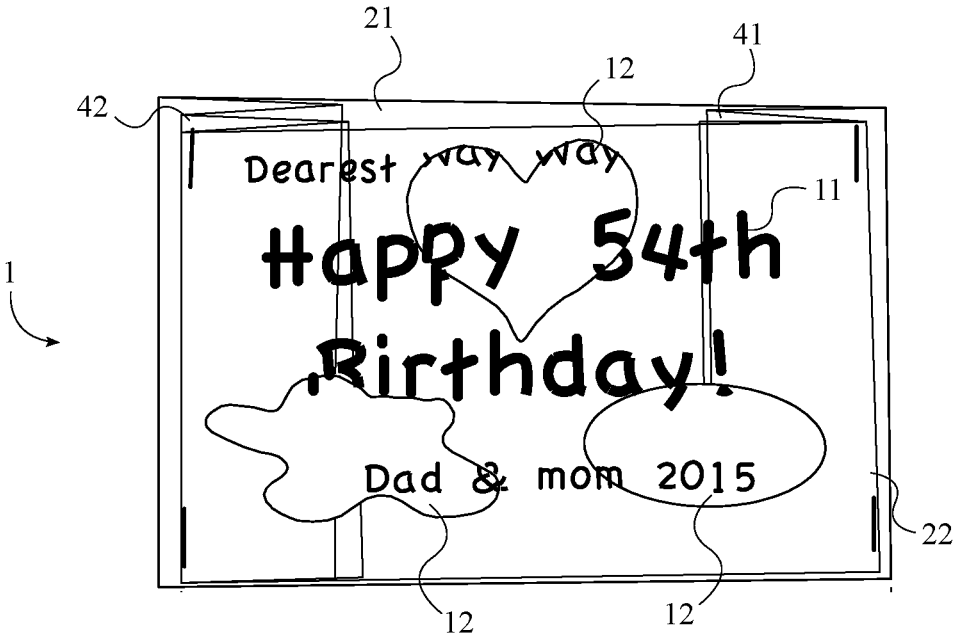
FIG. 4C is a frontal view of the greeting card arranged according to a method of the present invention.
Figure 4D:
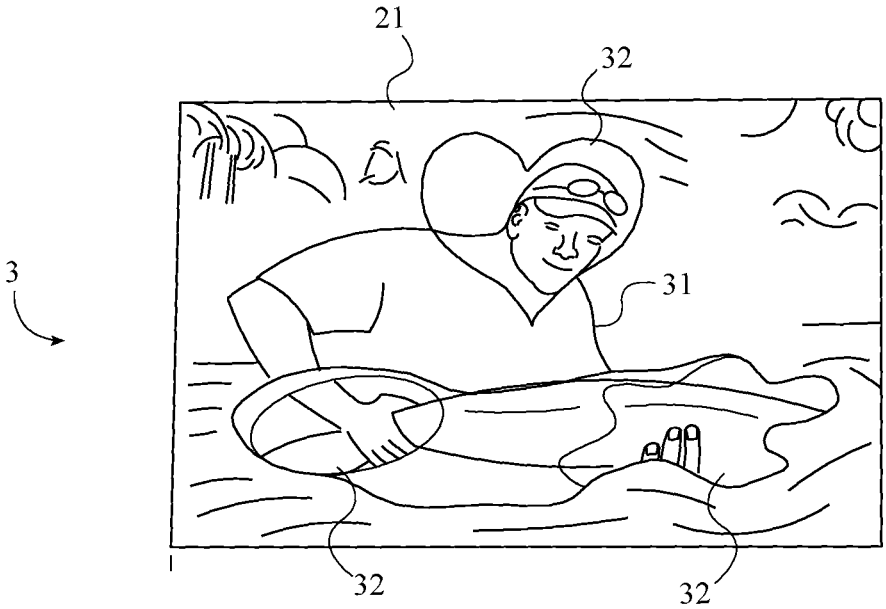
FIG. 4D is a rear view of the greeting card arranged according to a method of the present invention.

In an embodiment, greeting cards can be created and assembled according to the method of the present invention. The greeting card comprising a message, image or picture, or its combinations can be segmented and arranges in parallel planes for depth viewing. For example, images can be printed directly on, or upon removable labels affixed to, transparent plastic sheets, of greeting cards size. The labels containing the images are cut into random shapes (for example heart, oval, amoeba shaped cut outs). FIG. 4A shows a side view of the greeting card comprising a plurality of segments arranged in parallel viewing panels. FIG. 4B shows an oblique view of the greeting card comprising segments of the message distributed over different parallel panels. The card, when viewed from an oblique angle, only reveals certain parts of the message. FIG. 4C shows a frontal view of the greeting card revealing a complete message. The viewing panels are arranged in such a way so as to reveal the complete message only when viewed directly from the front side. Similarly, the rear side of the card comprises an image that is segmented and arranged in similar manner on the reverse side of the panels such that it reveals a complete image only when viewed directly from the rear side. FIG. 4D shows a rear view of the greeting card revealing a complete image or picture, thus providing a pleasant and surprising sensation of depth due to the separation of segment planes.

Figure 5A:
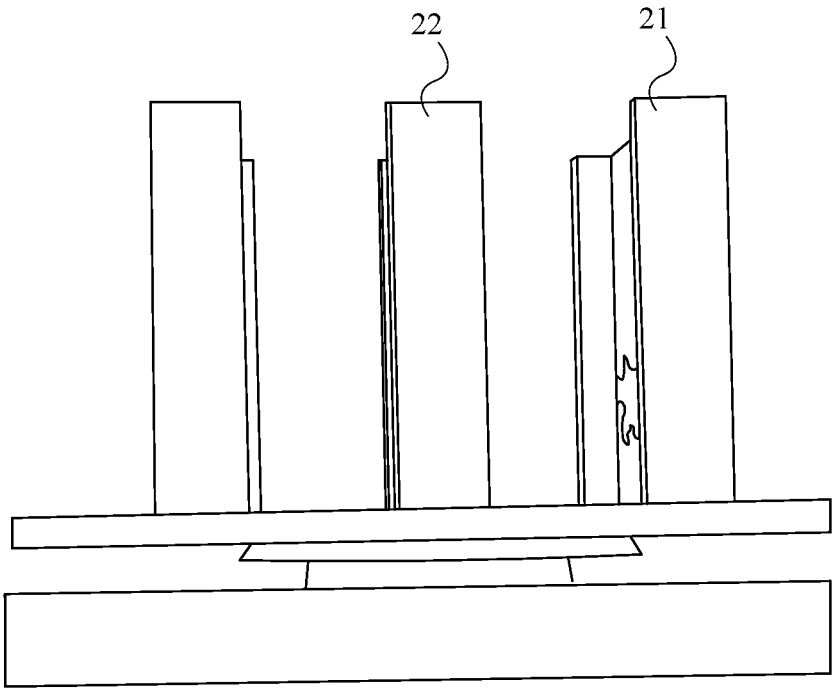
FIG. 5A is a side view of an artwork displayed according to a method of the present invention.
Figure 5B:
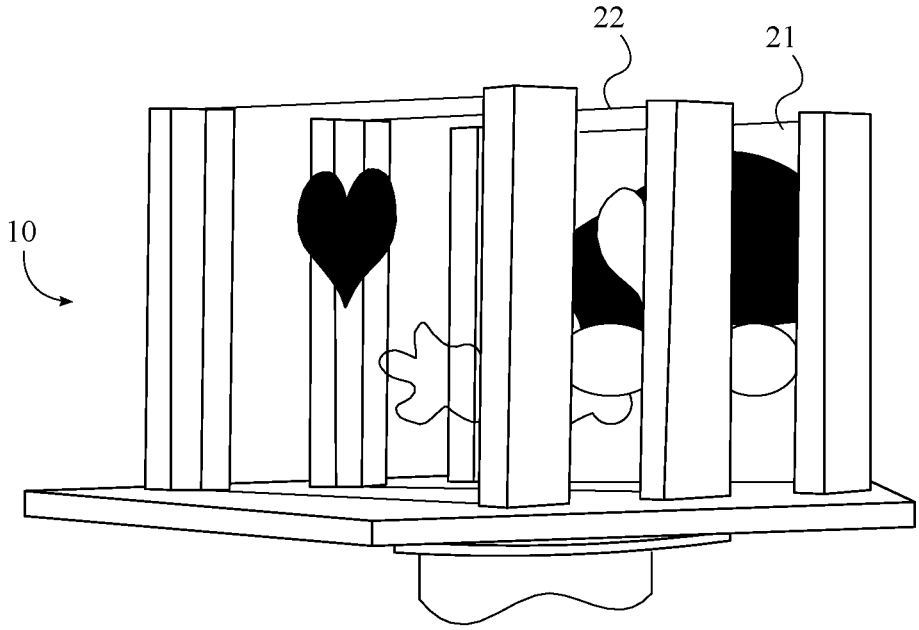
FIG. 5B is an oblique view of the artwork displayed according to the method of the present invention.
Figure 5C:
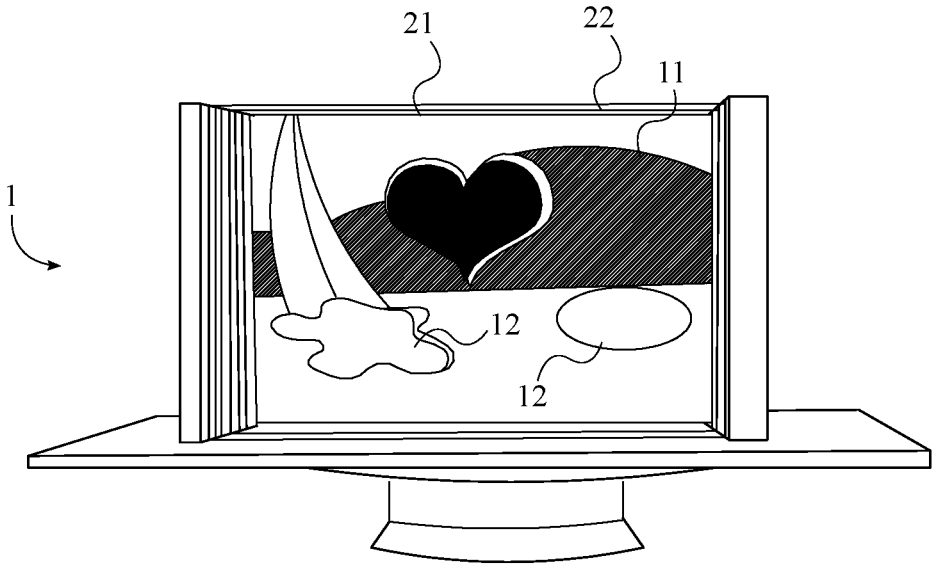
FIG. 5C is a frontal view of the artwork displayed according to the method of the present invention.
Figure 5D:
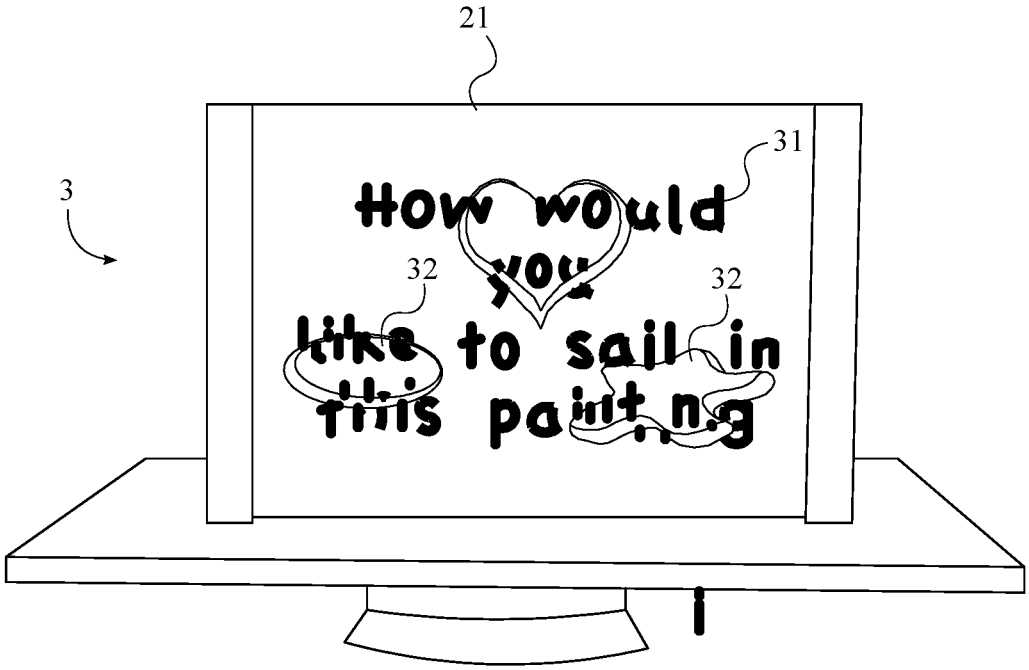
FIG. 5D is a rear view showing the reverse side of the artwork displayed according to the method of the present invention.

In an embodiment, the present invention relates to a method of displaying an artwork using transparent material such as plexiglass substrate material. The two vertical edges of each plexiglass panel are inserted into respective slots on two wooden holders so that the panels are held upright for viewing. In an example, an image can be printed on a removable label, segmented into random shapes (such as cut-outs of different shapes), affixed to the transparent plexiglass substrates and arranged in parallel planes. These panels are placed above a motor-driven rotating platform. The artwork display can be viewed from different perspectives due to the rotational movement of the platform. For example, FIG. 5A shows a side view of the artwork arrangement, wherein only the wooden holders are visible. FIG. 5B shows an oblique view of the artwork arrangement, where the heart-shaped cut-out affixed to one of the panels is clearly visible. FIG. 5C shows a frontal view of the artwork arrangement revealing a complete painting. The frontal view renders the three cut-outs (heart shaped, oval shaped, amoeba shaped) from different planes to fit into their respective positions and reveal the complete painting. Similarly, the rear side of the plexiglass substrate can be affixed with a removable label comprising a text message. The labels are similarly segmented and arranged in parallel planes so that they reveal a complete message or text only when viewed directly from the rear side. FIG. 5D shows a rear view of the artwork arrangement revealing a complete message.

Although the above embodiments in FIGS. 1 and 2 disclose segments that are axially symmetric, in other embodiments the segments can also be axially asymmetric as in FIGS. 4 and 5. In addition to the above embodiments, three-dimensional objects can also be used for bearing one or more segmented images reproduced or affixed on different dimensions or faces of the object, such that the segments reveal a different picture when viewed from each dimension or face.

In another embodiment, the artwork can be reproduced or projected on faces of a plurality of buildings within a building complex, such that the whole building complex surprisingly reveals a complete unexpected image when viewed from one or more specific locales. For example, an artwork comprising a painting can be recreated or projected in segments on the faces of multiple buildings within a complex, such that the building complex surprisingly reveals a complete painting when viewed from a specific locale.

In another embodiment, the artwork can be reproduced or projected on faces of a plurality of billboards such that the artwork is only partially viewable or appears to be incomplete until the viewer reaches a certain viewing angle or position, whereby a complete unexpected image is revealed. In an exemplary embodiment, highway billboards or billboards adjacent to train tracks, may be arranged such that the artwork is revealed only when viewed from a flat, straight section, but appears incomplete when viewed from a hill or curve approaching the billboard. In another example, the billboard can be arranged in such a way to reveal the artwork or advertisement only when viewed from the front or from the sides.

Figure 8A:
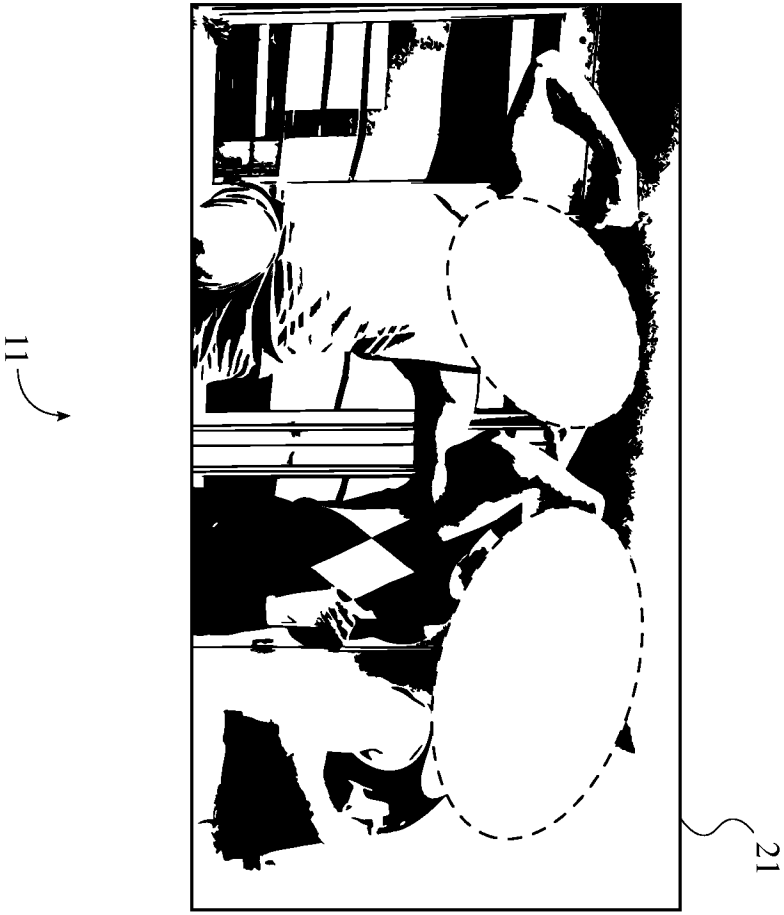
FIG. 8A is a front view showing the first image segment being imposed on the first substrate.
Figure 8B:
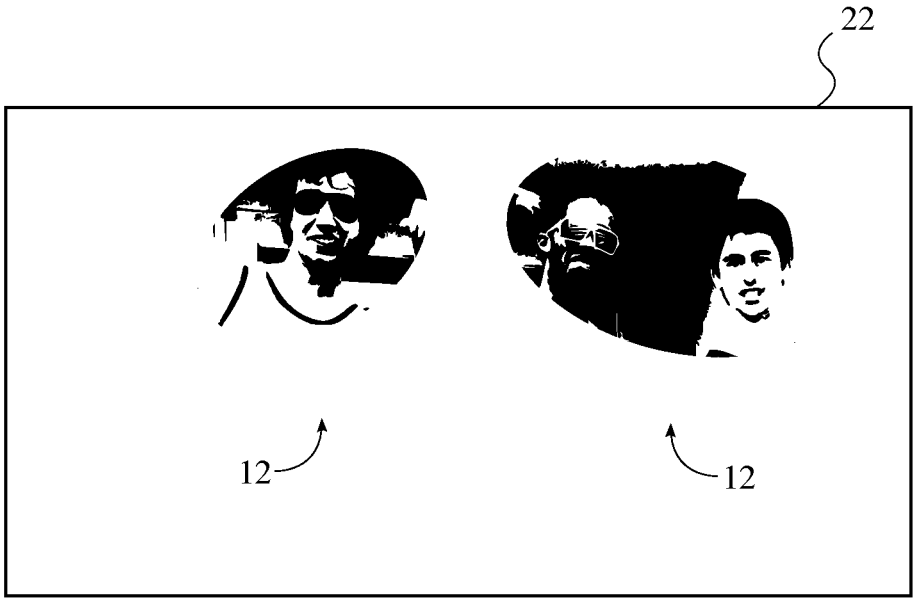
FIG. 8B is a front view showing the at least one subsequent image segment being imposed on the second substrate.
Figure 8C:
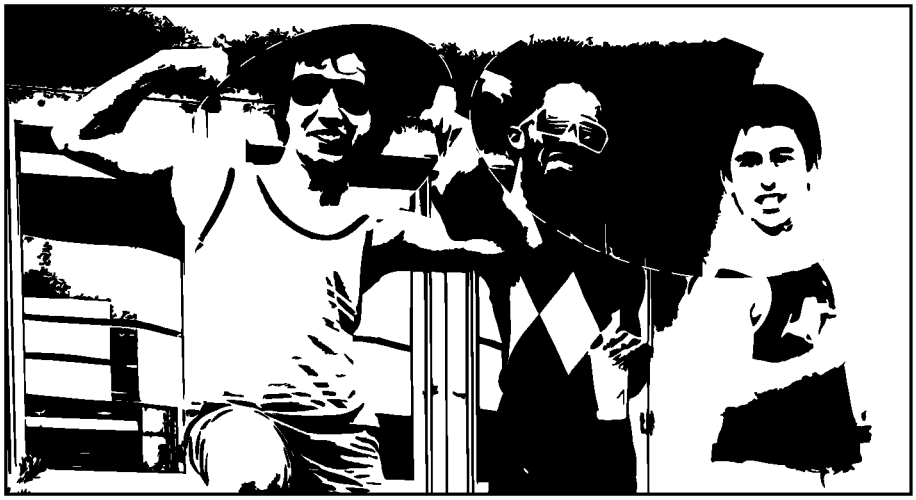
FIG. 8C is a front view, wherein the first substrate and the second substrate are viewed from the predetermined angle to show the complete image.

In an embodiment of the present invention, the three-dimensional artwork comprises a plurality of image segments 10, a first substrate 21, and a second substrate 22. In reference to FIG. 8G, the first substrate 21 and the second substrate 22 are positioned parallel to each other, wherein the first substrate 21 is offset from the second substrate 22. Meanwhile, the plurality of image segments 10 is arranged on the first substrate 21 and the second substrate 22 to form a complete image 1, as depicted in FIG. 8C, when the first substrate 21 and the second substrate 22 are viewed from a predetermined angle 15 shown in FIG. 8G.

The plurality of image segments 10 comprises a first image segment 11 and an at least one subsequent image segment 12. The first image segment 11 is imposed on the first substrate 21, as depicted in FIG. 8A, while the at least one subsequent image segment 12 is imposed on the second substrate 22, as depicted in FIG. 8B. When the first substrate 21 and the second substrate 22 are viewed from the predetermined angle 15, the first image segment 11 and the at least one subsequent image segment 12 form the complete image 1 as shown in FIG. 8C. The offset between the first substrate 21 and the second substrate 22 gives the complete image 1 a perceived depth that would not be experienced if the plurality of image segments 10 was depicted on a single surface.

Figure 8D:
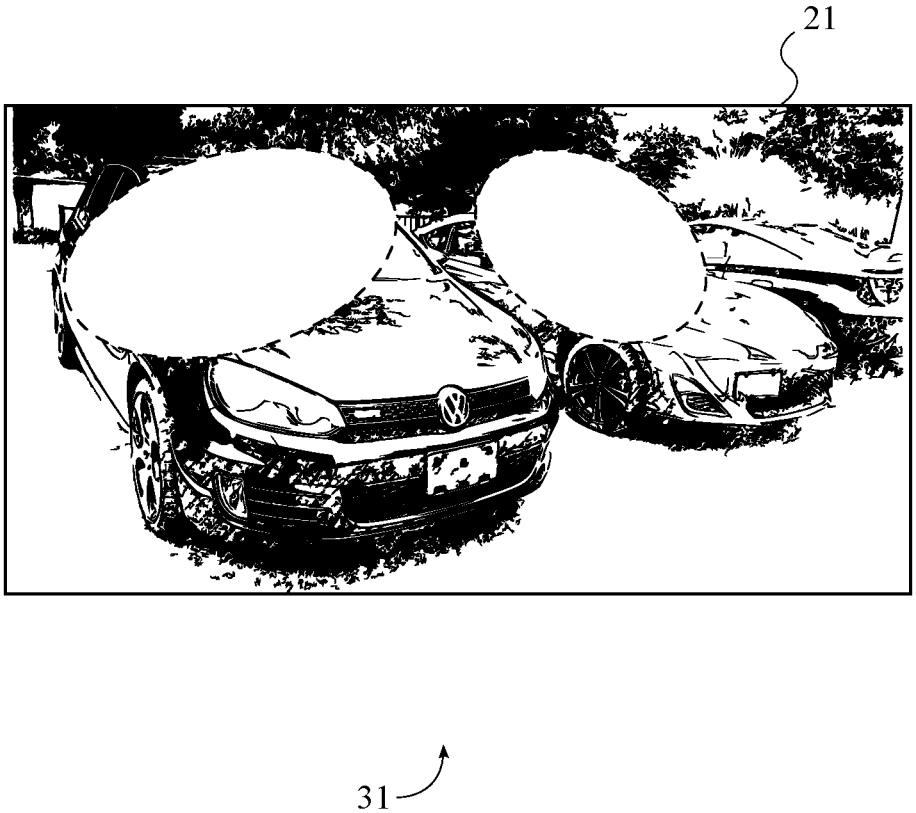
FIG. 8D is a rear view showing the first disparate image segment being imposed on the first substrate opposite the first image segment.
Figure 8E:
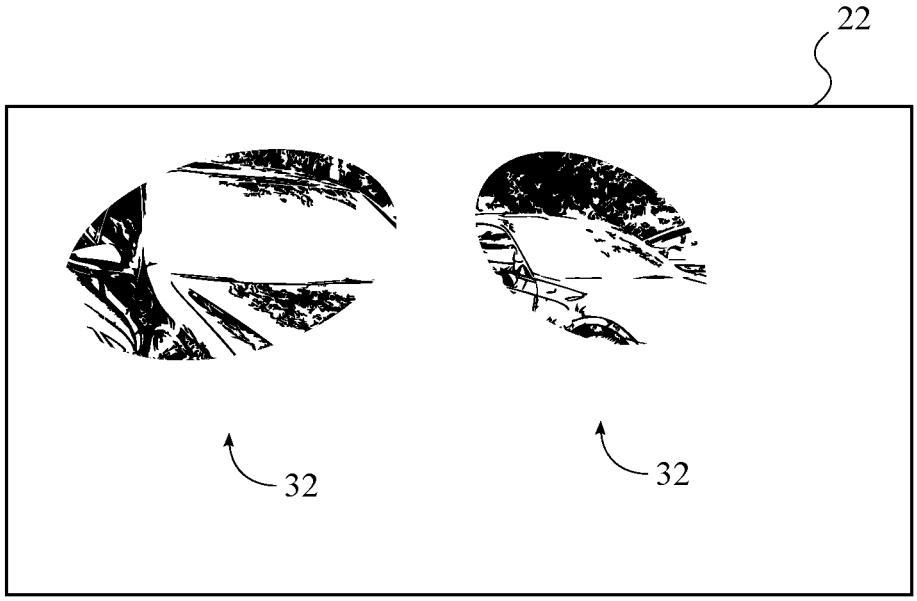
FIG. 8E is a rear view showing the at least one subsequent disparate image segment being imposed on the second substrate opposite the at least one subsequent image segment.
Figure 8F:
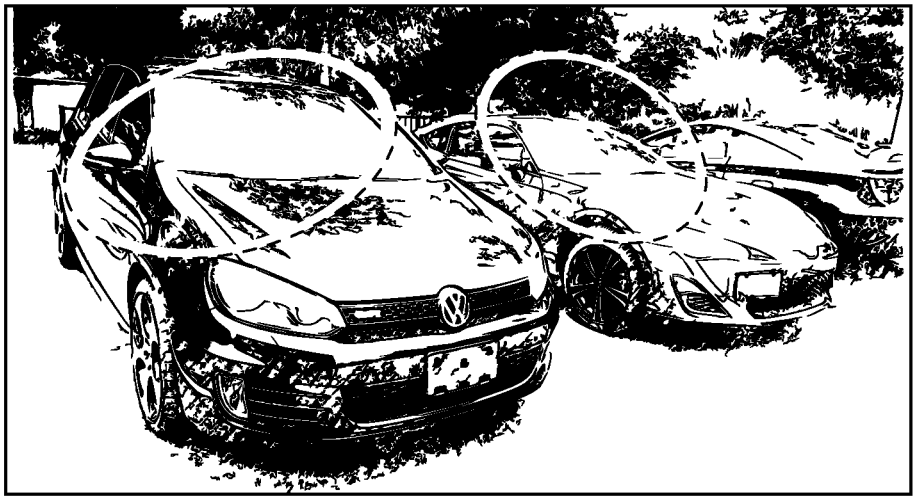
FIG. 8F is a rear view, wherein the first substrate and the second substrate are viewed from the predetermined disparate angle to show the complete disparate image.
Figure 8G:
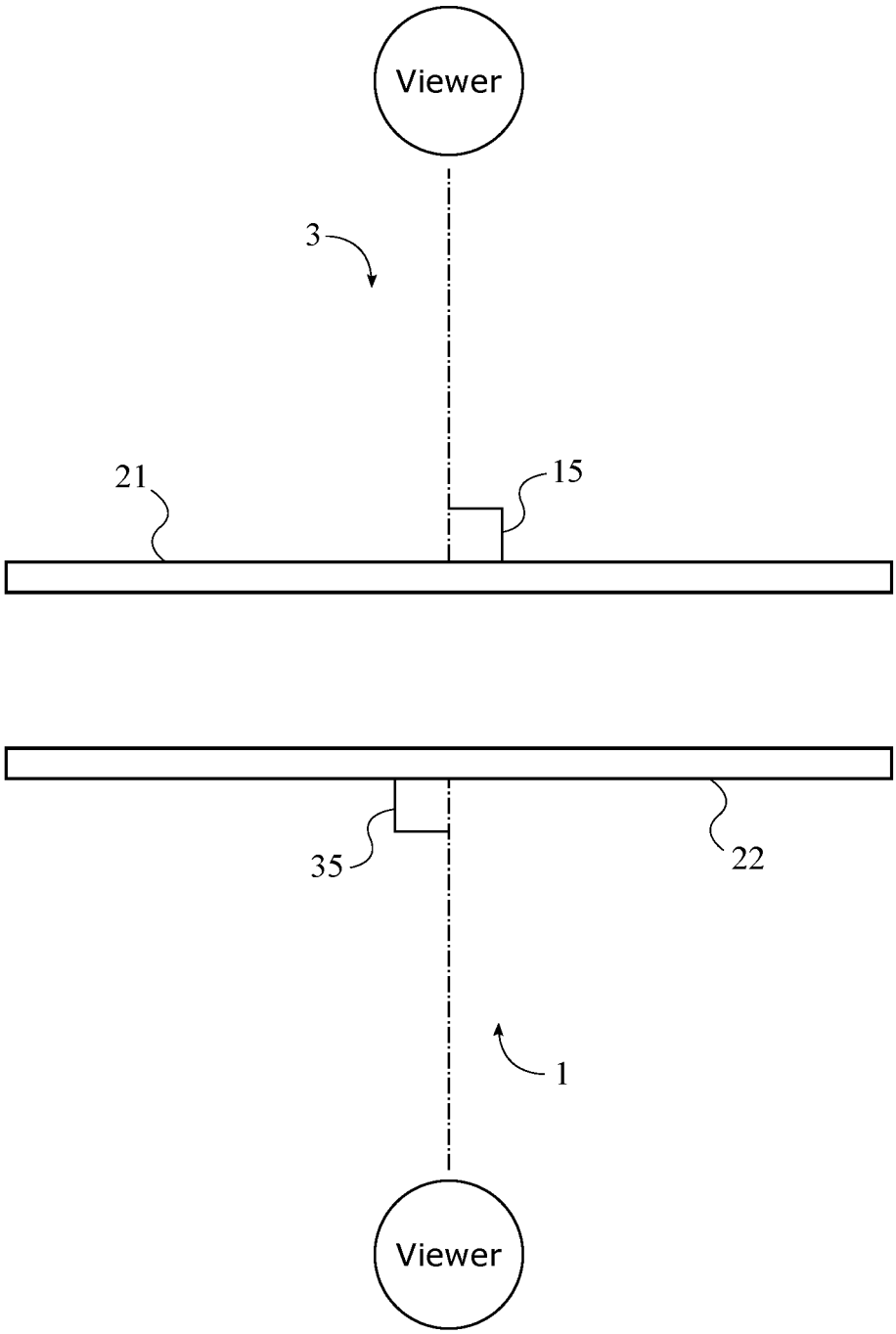
FIG. 8G is a top view showing both the predetermined angle and the predetermined disparate angle being 90 degrees relative to the first substrate and the second substrate.

In one embodiment, the predetermined angle 15 is 90 degrees to the first substrate 21 and the second substrate 22, as depicted in FIG. 8G. When the first image segment 11 and the at least one subsequent image segment 12 are viewed at 90 degrees normal to the planes of the first substrate 21 and the second substrate 22, the complete image 1 is revealed to the viewer; the complete image 1 having the perceived depth due to the offset nature of the first substrate 21 and the second substrate 22. In other embodiments, the predetermined angle 15 may be a different value between 0 and 180 degrees relative to the planes of the first substrate 21 and the second substrate 22.

In some embodiments of the present invention, the first substrate 21 and the second substrate 22 are planar objects, wherein the first substrate 21 is perimetrically mounted to the second substrate 22. In one such embodiment, the first substrate 21 is connected to the second substrate 22 at each of four corners by a dowel. The use of dowels for mounting the first substrate 21 to the second substrate 22 creates a fixed distance between the first substrate 21 and the second substrate 22. Thus, the perceived depth of the complete image 1 is only variable by the distance of the viewer from the artwork.

In reference to FIG. 4A-4D, in another embodiment, a first accordion connector 41 and a second accordion connector 42 are connected in between the first substrate 21 and the second substrate 22. The first accordion connector 41 and the second accordion connector 42 are positioned parallel to each other and are positioned opposite each other along the first substrate 21 and the second substrate 22. The first accordion connector 41 and the second accordion connector 42 can be extended and collapsed in order to vary the distance between the first substrate 21 and the second substrate 22. Thus, the first accordion connector 41 and the second accordion connector 42 allow the perceived depth of the complete image 1 to be varied. Additionally, the first accordion connector 41 and the second accordion connector 42 allow the three-dimensional artwork to be featured as a greeting card, or other card, and packaged in an envelope.

In some embodiments, at least one of the first substrate 21 and the second substrate 22 is transparent. The first image segment 11 and/or the at least one subsequent image segment 12 obstruct a portion of the first substrate 21 and/or the second substrate 22 respectively. Meanwhile, the viewer can see though the remainder of the first substrate 21 and/or the second substrate 22. FIG. 4A-4D and FIG. 8A-8G depict the first substrate 21 and the second substrate 22 as being transparent, wherein the plurality of image segments 10 and the plurality of disparate image segments 30 partially obstruct the first substrate 21 and the second substrate 22.

In reference to FIG. 9A-9E, in some embodiments, each of the first substrate 21 and the second substrate 22 is a side of a polyhedron. More specifically, the first substrate 21 is the side of a first polyhedron and the second substrate 22 is the side of a second polyhedron. The first polyhedron and the second polyhedron are the same shape but of different size. The first polyhedron is offset from the second polyhedron to obtain the perceived depth of the complete image 1, when the three-dimensional artwork is viewed from the predetermined angle 15.

Figure 9A:
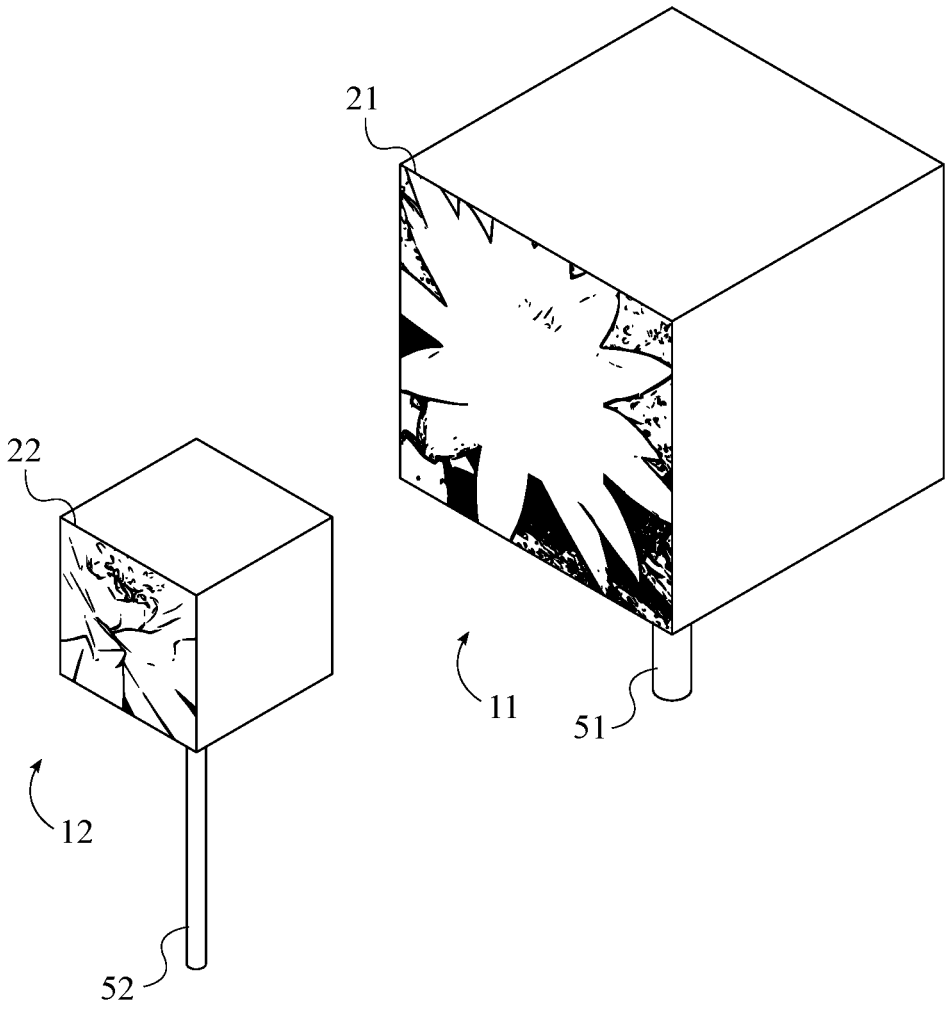
FIG. 9A is a perspective view, wherein the first substrate is a side of a first polyhedron and the second substrate is a side of a second polyhedron.
Figure 9B:
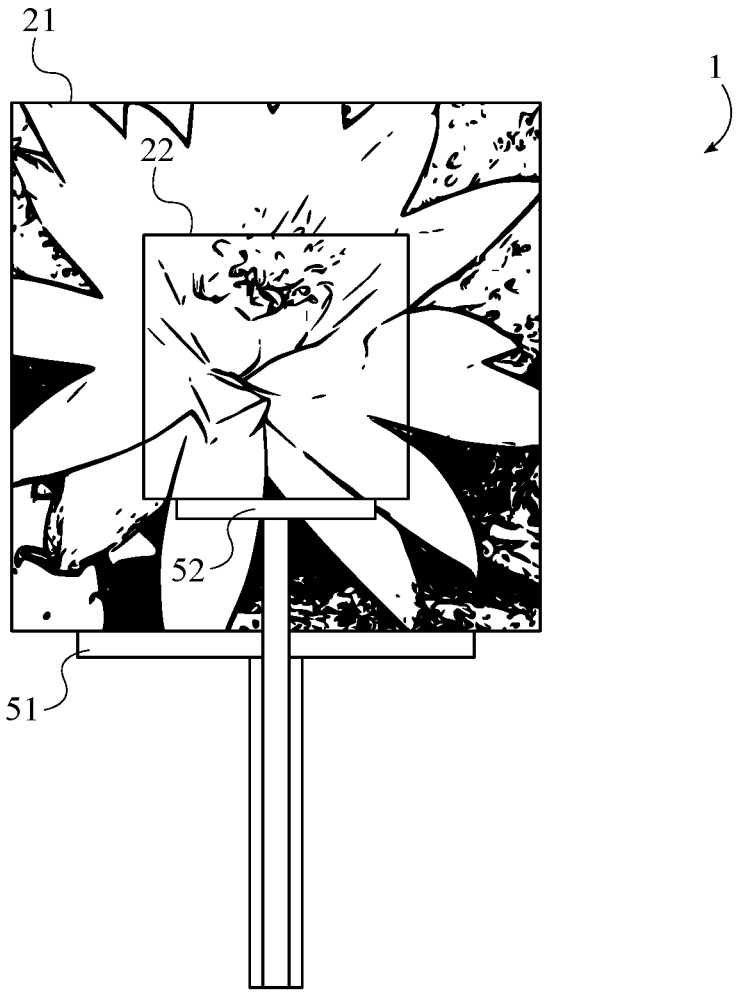
FIG. 9B is a front view, wherein the first substrate and the second substrate are viewed from the predetermined angle to show the complete image.
Figure 9C:
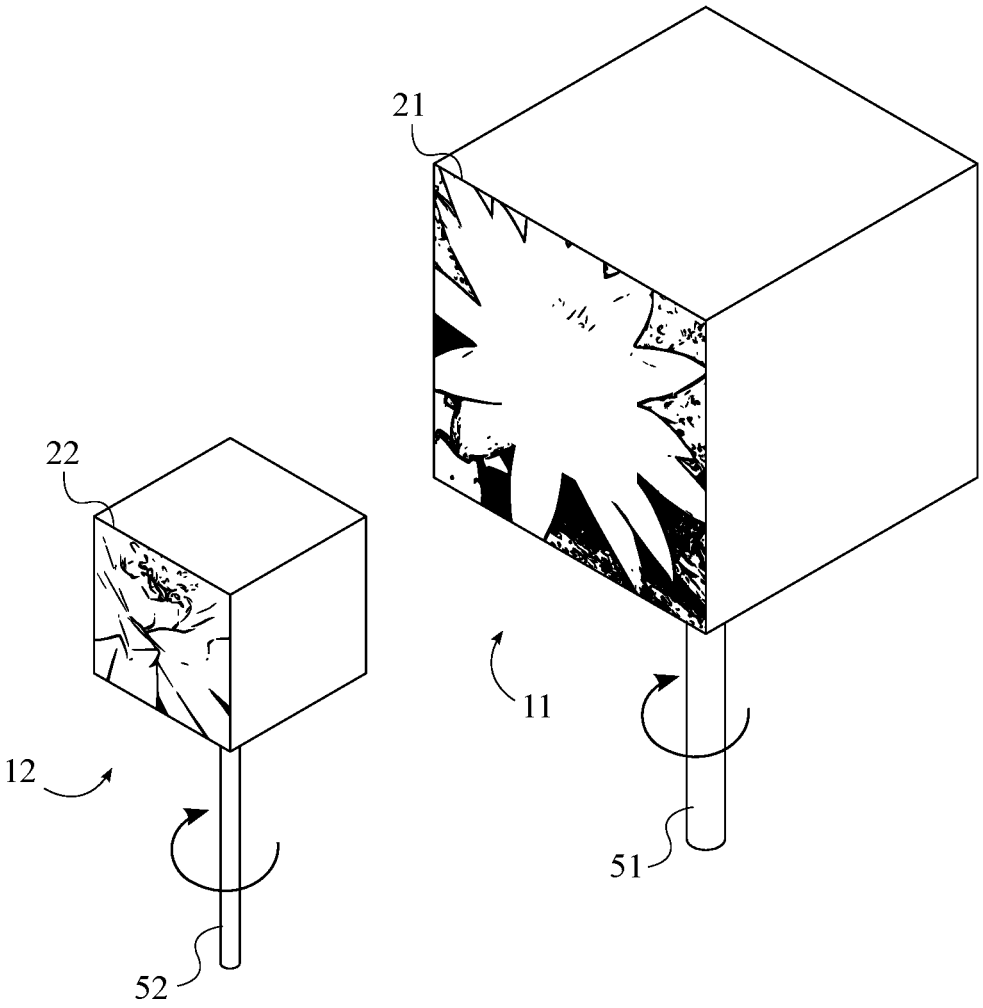
FIG. 9C is a perspective view, wherein the first rotating platform and the second rotating platform are configured to rotate in the same direction.
Figure 9D:
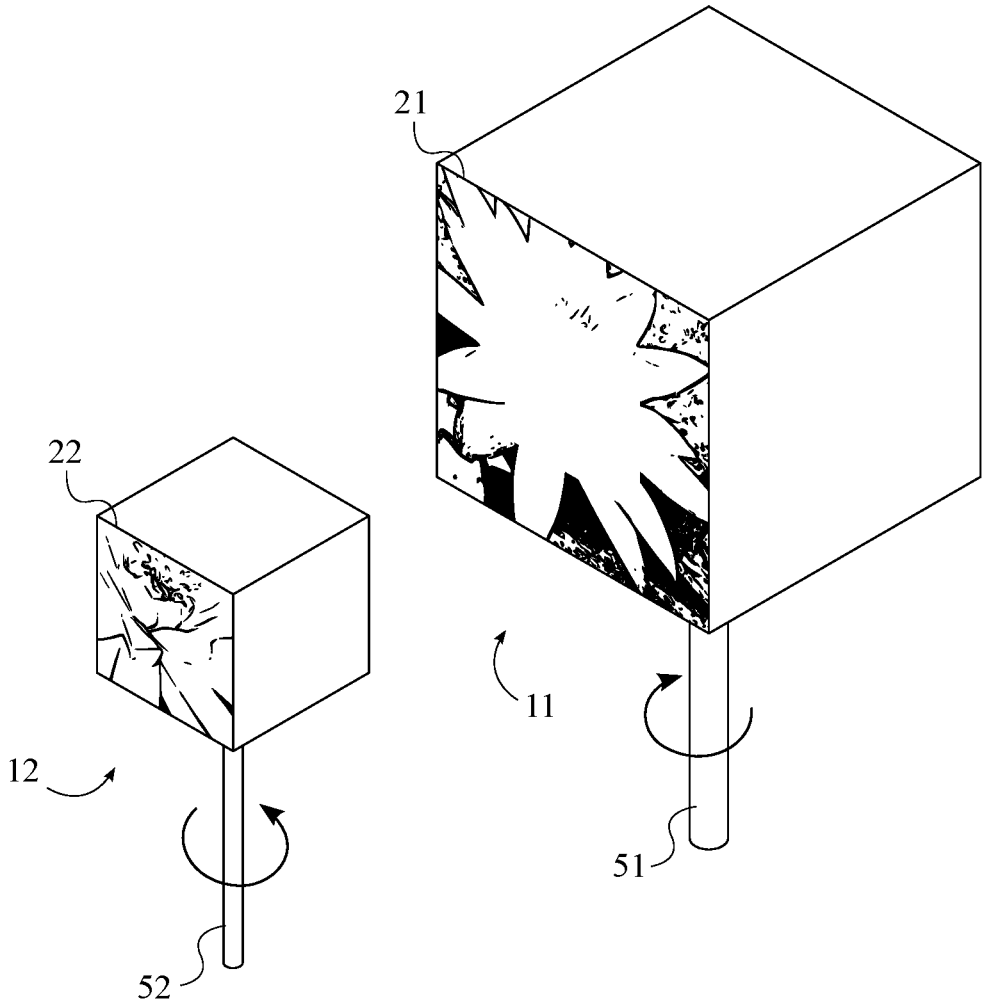
FIG. 9D is a perspective view, wherein the first rotating platform and the second rotating platform are configured to rotate in opposite directions.
Figure 9E:
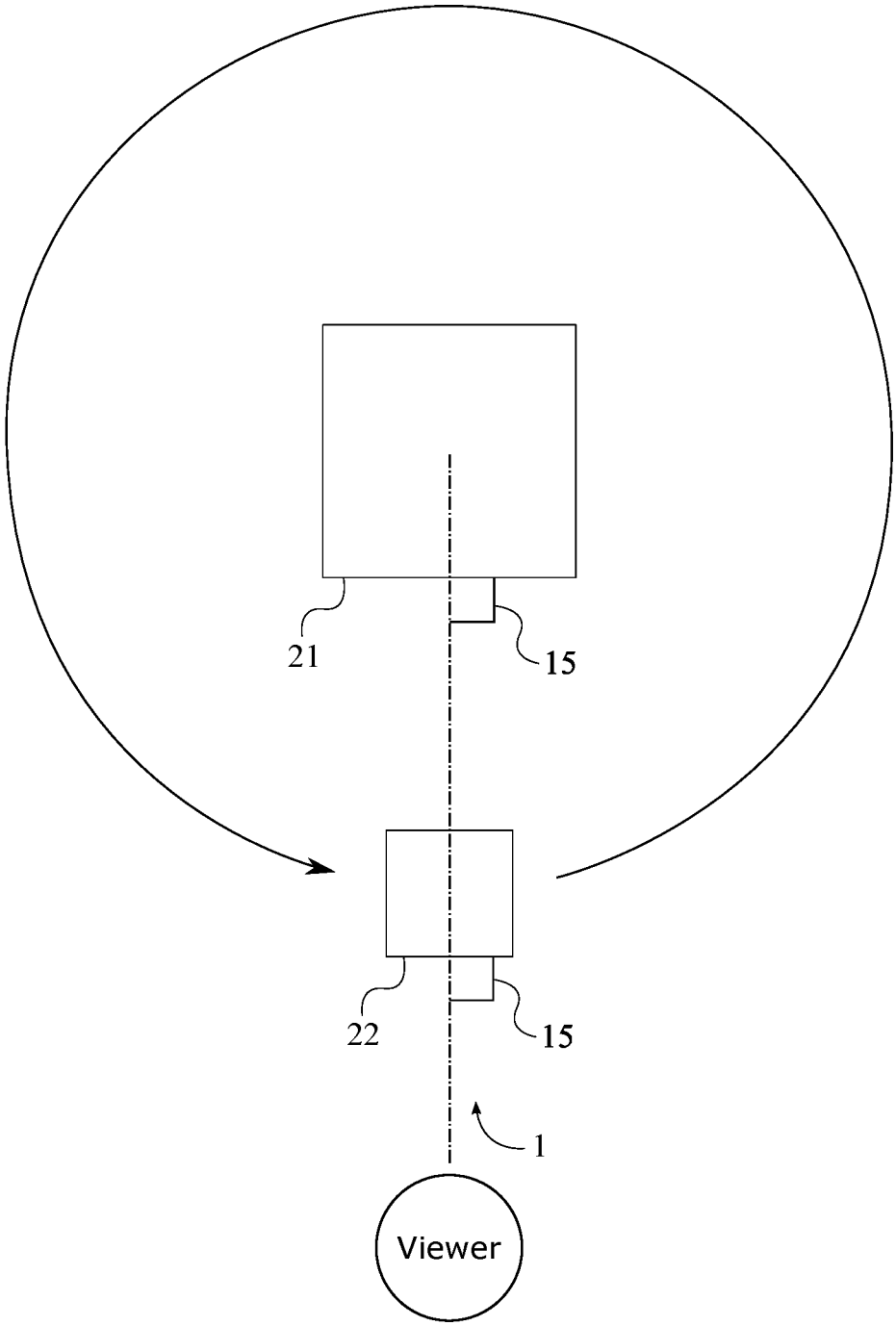
FIG. 9E is a top view, wherein the second rotating platform is configured to orbit around the first platform.

In some embodiments, wherein the first polyhedron and the second polyhedron are utilized, additional image segments may be applied to the other sides of both the first polyhedron and the second polyhedron. Further, a first rotating platform 51 and a second rotating platform 52 may be utilized, wherein the first polyhedron is mounted to the first rotating platform 51 and the second polyhedron is mounted to the second rotating platform 52, as shown in FIGS. 9A and 9B. The first polyhedron and the second polyhedron can then be made to rotate, via the first rotating platform 51 and the second rotating platform 52 respectively, such that the image segments of the various sides intermittently align to form a series of complete images. The first rotating platform 51 and the second rotating platform 52 may be configured to rotate in the same direction as depicted in FIG. 9C, or in opposite directions as depicted in FIG. 9D, depending on the desired effect.

In some embodiments of the present invention, the three-dimensional artwork comprises a plurality of disparate image segments 30. Similar to the plurality of image segments 10, the plurality of disparate image segments 30 is arranged on the first substrate 21 and the second substrate 22 to form a complete disparate image 3, as depicted in FIG. 8F, when the first substrate 21 and the second substrate 22 are viewed from a predetermined disparate angle 35 shown in FIG. 8G. However, the plurality of disparate image segments 30 is distributed about the opposite side of the first substrate 21 and the second substrate 22.

The plurality of disparate image segments 30 comprises a first disparate image segment 31 and an at least one subsequent disparate image segment 32. The first disparate image segment 31 is imposed on the first substrate 21 opposite the first image segment 11, as depicted in FIG. 8D, while the at least one subsequent disparate image segment 32 is imposed on the second substrate 22 opposite the at least one subsequent image segment 12, as depicted in FIG. 8E. When the first substrate 21 and the second substrate 22 are viewed from the predetermined disparate angle 35, the first disparate image segment 31 and the at least one subsequent disparate image segment 32 form the complete disparate image 3 as shown in FIG. 8F. The offset between the first substrate 21 and the second substrate 22 gives the complete disparate image 3 a perceived depth that would not be experienced if the plurality of disparate image segments 30 was depicted on a single surface.

In one embodiment, the predetermined disparate angle 35 is 90 degrees to the first substrate 21 and the second substrate 22, as depicted in FIG. 8G. When the first disparate image segment 31 and the at least one subsequent disparate image segment 32 are viewed at 90 degrees normal to the planes of the first substrate 21 and the second substrate 22, the complete disparate image 3 is revealed to the viewer; the complete disparate image 3 having the perceived depth due to the offset nature of the first substrate 21 and the second substrate 22. In other embodiments, the predetermined disparate angle 35 may be a different value between 0 and 180 degrees relative to the planes of the first substrate 21 and the second substrate 22.

Figure 6:
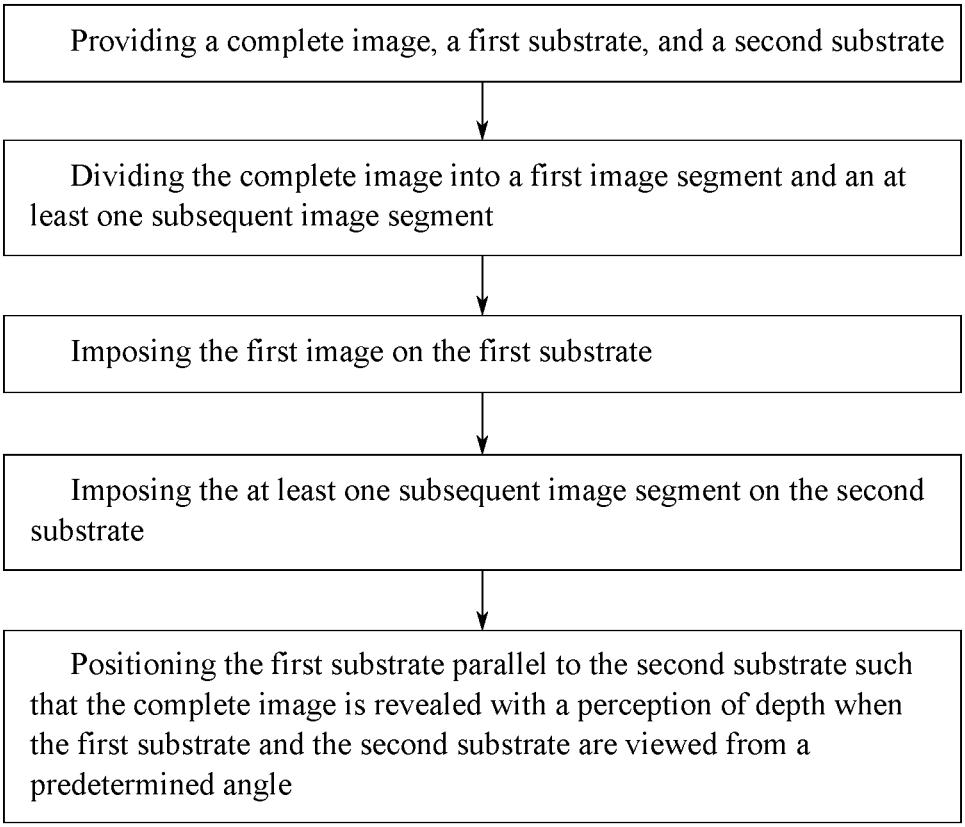
FIG. 6 is a flowchart depicting the steps for displaying a complete image of an artwork.

In reference to FIG. 6, one method for displaying the three-dimensional artwork requires the complete image 1 to first be divided into the first image segment 11 and the at least one subsequent image segment 12. The first image segment 11 is then imposed on the first substrate 21, while the at least one subsequent image segment 12 is imposed on the second substrate 22. The first substrate 21 and the second substrate 22 are then positioned parallel to each other such that the complete image 1 is revealed with the perception of depth, when the first substrate 21 and the second substrate 22 are viewed from the predetermined angle 15.

Figure 7:
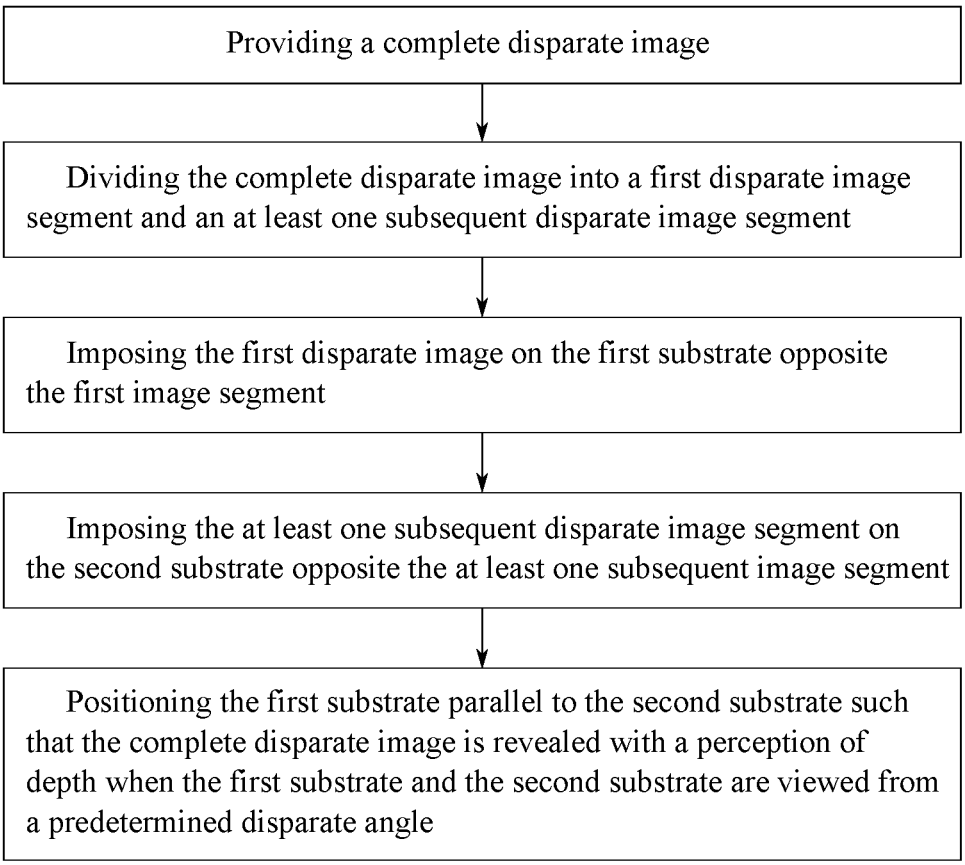
FIG. 7 is a flowchart thereof, depicting the steps for displaying a complete disparate image of the artwork, opposite the complete image.

In reference to FIG. 7, if the complete disparate image 3 is to be displayed in addition to the complete image 1, then the complete disparate image 3 is also divided into the first disparate image segment 31 and the at least one subsequent disparate image segment 32. After the complete disparate image 3 has been divided, the first disparate image segment 31 is imposed on the first substrate 21 opposite the first image segment 11, while the at least one subsequent disparate image segment 32 is imposed on the second substrate 22 opposite the at least one subsequent image segment 12. When the first substrate 21 is positioned parallel to the second substrate 22, and the first substrate 21 and the second substrate 22 are viewed from the predetermined disparate angle 35, the complete disparate image 3 is revealed with the perception of depth.

The present invention has been described with several preferred embodiments thereof and it is understood that many changes and modifications to the described embodiments can be carried out, without departing from the scope and the spirit of the invention that is intended to be limited only by the appended claims.

What is claimed is:

1. A three-dimensional artwork comprises:

a plurality of image segments;

a first image segment from the plurality of image segments being imposed on a first substrate;

an at least one subsequent image segment from the plurality of image segments being imposed on a second substrate;

the first substrate and the second substrate being parallel;

the first substrate being offset from the second substrate;

the first image segment and the at least one subsequent image segment forming a complete image when the first substrate and the second substrate are viewed from a predetermined angle;

a plurality of disparate image segments;

a first disparate image segment from the plurality of disparate image segments being imposed on the first substrate opposite the first image segment;

an at least one subsequent disparate image segment from the plurality of disparate image segments being imposed on the second substrate opposite the at least one subsequent image segment; and the first disparate image segment and the at least one subsequent disparate image segment forming a complete disparate image when the first substrate and the second substrate are viewed from a predetermined disparate angle.

2. The three-dimensional artwork as claimed in claim 1 comprises:

a first accordion connector and a second accordion connector; and the first accordion connector and the second accordion connector being connected in between the first substrate and the second substrate.

3. The three-dimensional artwork as claimed in claim 2 comprises:

the first accordion connector and the second accordion connector being parallel.

4. The three-dimensional artwork as claimed in claim 2 comprises:

the first accordion connector and the second accordion connector being positioned opposite each other along the first substrate and the second substrate.

5. The three-dimensional artwork as claimed in claim 1, wherein the predetermined angle is 90 degrees to the first substrate and the second substrate.

6. The three-dimensional artwork as claimed in claim 1, wherein each of the first substrate and the second substrate is a planar object.

7. The three-dimensional artwork as claimed in claim 1, wherein each of the first substrate and the second substrate is a side of a polyhedron.

8. The three-dimensional artwork as claimed in claim 1, wherein at least one of the first substrate and the second substrate is transparent.

9. The three-dimensional artwork as claimed in claim 1, wherein the predetermined disparate angle is 90 degrees to the first substrate and the second substrate.

10. A method of displaying an artwork, the method comprises the steps of:

providing a complete image, a first substrate, and a second substrate;

dividing the complete image into a first image segment and an at least one subsequent image segment;

imposing the first image segment on the first substrate;

imposing the at least one subsequent image segment on the second substrate;

positioning the first substrate parallel to the second substrate such that the complete image is revealed with a perception of depth when the first substrate and the second substrate are viewed from a predetermined angle;

providing a complete disparate image;

dividing the complete disparate image into a first disparate image segment and an at least one subsequent disparate image segment;

imposing the first disparate image on the first substrate opposite the first image segment;

imposing the at least one subsequent disparate image segment on the second substrate opposite the at least one subsequent image segment; and positioning the first substrate parallel to the second substrate such that the complete disparate image is revealed with a perception of depth when the first substrate and the second substrate are viewed from a predetermined disparate angle.

11. The method of displaying an artwork, the method as claimed in claim 10, wherein each of the first substrate and the second substrate is a planar object.

12. The method of displaying an artwork, the method as claimed in claim 10, wherein each of the first substrate and the second substrate is a side of a polyhedron.

13. The method of displaying an artwork, the method as claimed in claim 10, wherein at least one of the first substrate and the second substrate is transparent.

* * * * *